United States Patent [19]

Hartman

[11] Patent Number: 5,032,101

[45] Date of Patent: Jul. 16, 1991

[54] SPINNING TOY

[76] Inventor: Victor L. Hartman, 204 N. 8th St., Council Grove, Kans. 66846

[21] Appl. No.: 479,365

[22] Filed: Feb. 12, 1990

[51] Int. Cl.[5] ..... A63H 1/08; A63H 1/20

[52] U.S. Cl. ..... 446/262; 446/235

[58] Field of Search ..... 446/256, 258, 259, 260, 446/261, 262, 233, 234, 235

[56] References Cited

U.S. PATENT DOCUMENTS

| | | | |
|---|---|---|---|
| 656,771 | 8/1900 | Koscialowski | 446/262 |
| 837,316 | 12/1906 | Massette | 446/261 |
| 925,479 | 6/1909 | Irving | 446/235 |
| 1,363,718 | 12/1920 | Cayo | 446/262 X |
| 2,991,584 | 7/1961 | Kaufman | 446/235 |
| 3,523,386 | 8/1970 | Brown | 446/233 |

FOREIGN PATENT DOCUMENTS

| | | | |
|---|---|---|---|
| 1016115 | 11/1952 | France | 446/263 |
| 1190231 | 10/1959 | France | 446/233 |
| 282762 | 5/1952 | Switzerland | 446/262 |

*Primary Examiner*—Robert A. Hafer
*Assistant Examiner*—D. Neal Muir
*Attorney, Agent, or Firm*—Bruce J. Clark

[57] ABSTRACT

An improved spinning toy comprised of a primary flywheel affixed near one end of a shaft penetrating the central axis, a symmetrical handle having a specific size, shape, and relational location rotatably connected about the shaft penetrating it; a smaller secondary flywheel near the lower end of the handle through which the shaft penetrates, two end caps having conical terminations, flat protruding surfaces on the sides of the handle, a tangential line of the handle having the lower end tip in the line, and a hole in the handle through which a string passes.

4 Claims, 2 Drawing Sheets

SPINNING TOY

BACKGROUND OF THE INVENTION

This invention relates to an improved spinning toy. While spinning tops themselves are not new (Boyer, U.S. Pat. No. 593,173; Koscialowski, U.S. Pat. No. 656,771; Hyne, U.S. Pat. No. 661,052; Duncan, U.S. Pat. No. 1,108,725; Samour, U.S. Pat. No. 1,419,690; Kieler, U.S. Pat. No. 1,631,272; Petrosky, U.S. Pat. No. 1,811,022; Hartman, U.S. Pat. No. 2,767,514) most are directed to specific purposes, improvements, and designs.

It is the object of this invention to provide a high quality spinning toy that can not only spin on either end, but whose primary flywheel can spin when placed on its side or handle while the handle remains stationary, and will right itself on end from the side position, and will right itself when tossed on a surface with sufficient spin; that provides for a comfortable, quick, and efficient spinning and rewinding arrangement; and that can still be used as a hand-held reversible spinning toy.

Other objects and features of the invention and the manner in which it achieves its purpose will be appreciated from the following description and the accompanying drawings which exemplify the invention, it being understood that changes may be made in the specific apparatus disclosed herein without departing from the essentials of the invention set forth in the appended claims.

BRIEF SUMMARY OF THE INVENTION

The present invention relates to an improved spinning toy that spins on either end, spins while on its side, and will right itself on end as well. The invention is comprised of a symmetrical primary flywheel, a symmetrical handle, a secondary symmetrical flywheel, a shaft extending through the central axis of each and affixed to the primary flywheel, two end tips having essentially conical termination points, a hole in the handle through which the string passes and a protruding flat surface on the handle near the midsection tangential point. The handle's shape and position in itself and relative to the other elements allow for the objectives of the invention to be met.

DESCRIPTION OF THE PREFERRED EMBODIMENTS

Figure 1:
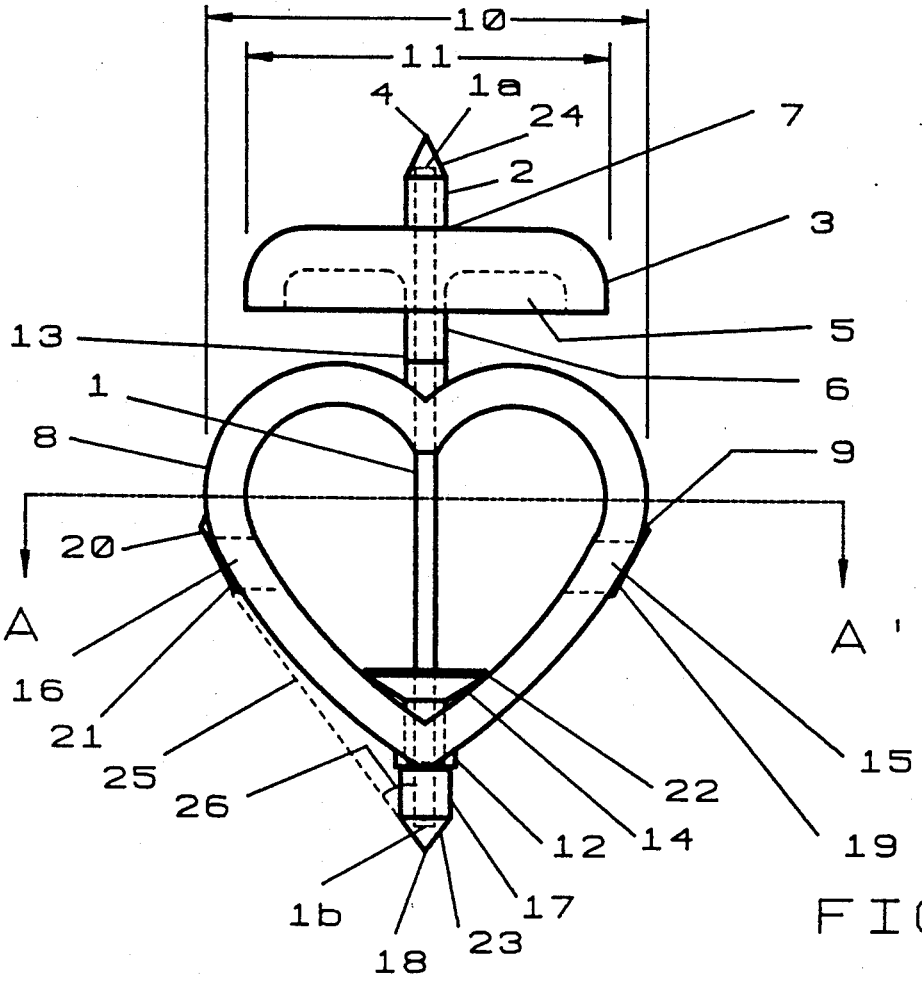
FIG. 1 is a front view of the invention showing interior portions.

Referring to FIG. 1, the invention shown has a rigid central shaft 1, having a top end 1*a* and a lower end 1*b*, and having top end cap 2 and lower end cap 17 affixed thereon at either end. The end caps 2 and 17 are pointed at their outer ends 4 and 18 to provide the balancing point for that end of the invention and can be glued or otherwise securely affixed to the shaft 1, or either may be molded with the shaft.

Figure 2:
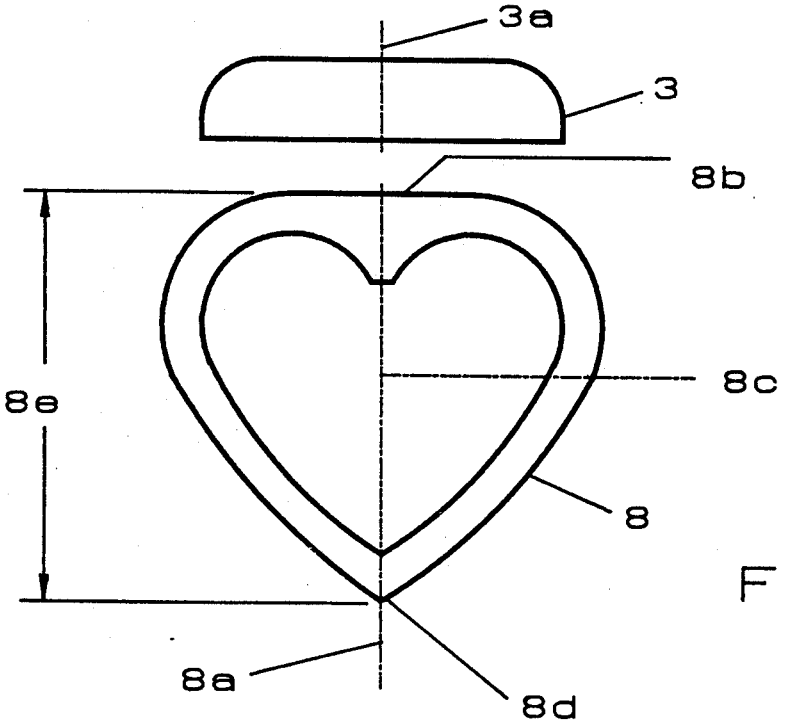
FIG. 2 is a view of the primary flywheel and handle showing their shape and central axis.
Figure 3:
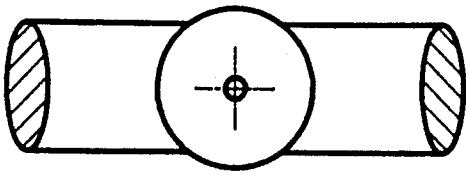
FIG. 3 is a view of Section AA' shown in FIG. 1.

The primary flywheel 3 is of an approximate cylindrical shape and symmetrical about its central axis 3*a* in FIG. 2. Although it may be solid, it is shown having an indented cup-shaped opening 5 on its lower inside. Its diameter 11 is the widest diameter of the primary flywheel perpendicular to the shaft. The primary flywheel 3 is affixed to the shaft 1 adjacent to the top end cap 2 at a relatively small distance. The primary flywheel is shown in FIG. 1 having a central shaft 6 which is also the central axis, radially centered thereon through which the shaft 1 extends and is glued or otherwise affixed allowing the primary flywheel to spin with the shaft.

The handle 8 is positioned adjacent to, and a relatively small distance from, the primary flywheel 3, at point 13. The handle is longitudinally centered on the shaft 1 to allow it to spin symmetrically about the shaft. This is further illustrated in FIG. 2 where the handle is shown as symmetrically shaped about its imaginary central axis 8*a*. The handle is shown as a heart shape in FIG. 1, having two symmetrical halves or sides, but other similar shapes are envisioned. It is important that the shape and size of the handle relative to itself and the other parts be such that its diameter 10, the widest diameter of the handle, be approximately equal to the diameter 11 of the primary flywheel and the longitudinal length of the handle 8*e*, within approximately 20% of each other, however it is preferred that the handle have a slightly wider diameter than that of the primary flywheel. The diameter 10 is perpendicular to the shaft, and also perpendicular to the longitudinal length. Moreover, the widest-most portion of the handle 8 as at 10 along AA', is located at or between the center 8*c* and the upper and 8*b* of the handles' central axis. The lower end 8*d* of the handle is located near the lower end of the shaft; the upper end 8*b* is located near the upper end. The preferred shape of the handle is further defined by its approximately straight contour in the proximity of points 9 and 20 on either side of the handle near the midpoint between the two ends. The preferred contour and position is shown as having protruding flat surfaces 19 and 21 extending the width of the handle. These flat surfaces are located on both sides of the handle, but their preferred location is such that they create the tangential points 19 and 21. They provide stability in the handle when it sets on its side when the primary flywheel is spinning. The contour of the handle from near point 8*b* to the opposite end near 8*d* is shown rounded to allow for ease of handling.

The shape of the handle is such that the angle of the imaginary straight line 25, a tangential line of the handle at the outer surface, extending through the lower end point 18 to one of the tangential points of the handle at 19 or 21 creates an angle 26 between it and the straight line of the shaft 1 of at least 15°. The tangential line 25 represents the surface upon which the top, if placed with the lower tip and handle touching the surface, would rest at the angle 26 of no less than 15° with the surface. The handle is shaped such that the tangential point is located approximately midway between the upper end and lower end of the handle or within 20% thereof.

A secondary flywheel 14 is positioned near the lower end of the handle, preferably affixed to the inside portion of the handle and adjacent thereto at the handle's narrowest end, opposite that end near the flywheel, although it can also be positioned between the handle and the lower end cap. The secondary flywheel is shown as preferred, essentially cone shaped, with its edges 22 having either a straight edge or slight curvature to resemble the inside surface of the handle. The secondary flywheel may also be affixed to the shaft, rather than affixed to the handle. The invention works best if the secondary flywheel is of a size, weight, and shape (and located on the shaft, at a position) such that the invention, when spinning on the tip 4, stabilizes in that position while spinning, thus allowing the invention to spin on either end.

The handle is maintained on the shaft in its position by the lower end tip 17, affixed to the shaft 1. The device spins on the tip point 18 in the upright position; in the upside down position, the device spins on tip point 4.

Figure 4:
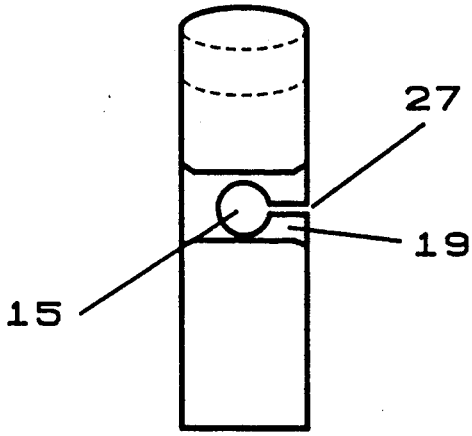
FIG. 4 is a side view of the handle 8.
Figure 5:
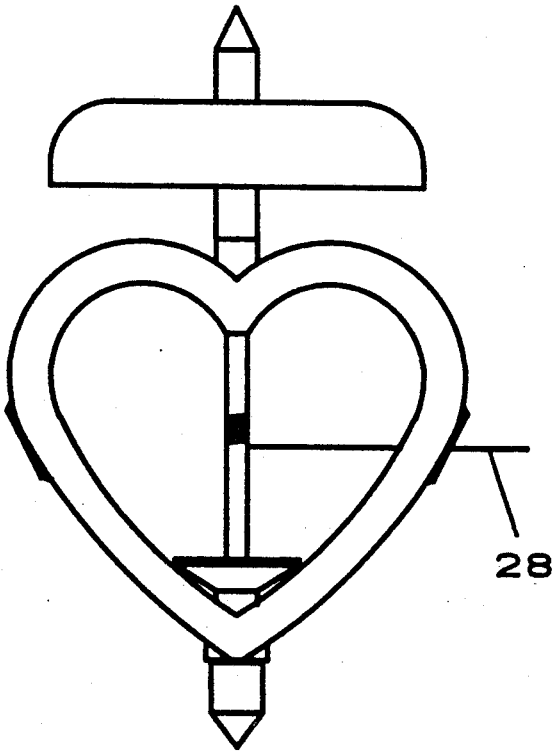
FIG. 5 is a front view of the invention.

Holes 15 and 16 are placed in the handle to allow the string 28 tied at one end to the shaft 1 to pass through for pulling to impart the spinning motion. By placing the hole 15 and 16 a substantial distance from either end 12 and 13 of the handle, preferably midway between or within 20% thereof, the string is guided for rewind and not caught or tangled between the handle 8 and the shaft when rewound during spinning. The slit 27 in FIG. 4 allows for quick threading of the string in the hole.

The end caps 2 and 17 are of a size and shape and location such that the tips 4 and 18 extend a relatively small distance beyond the primary flywheel 3 and handle 8, respectively, and such that the edges 23 and 24 near the tips 18 and 4 are essentially cone shaped.

The invention is used by holding the handle in one hand and turning the primary flywheel to easily wind the string; once wound, the string can be threaded through the hole and then either pulled back and forth while holding the handle, for a reversible spin or, with one firm pull and release of the string, the invention, once spinning, can be placed on either end to balance and spin, or it can be tossed on a hard surface or placed on either side (preferably the flat portions) on a hard surface, where, with sufficient spin, the tip 18 will, if not already touching, slowly draw towards the surface, and the invention will right itself, i.e. self balance, on tip 18.

The overall device as described provides an extremely versatile and enjoyable toy that allows it to spin on either end, self balance, provide for quick and easy rewinding and lack of tangling of the cord during spinning, is comfortable to hold and can also be spun back and forth while held in the hand.

What is claimed is:

1. A spinning toy comprised of:

a rigid shaft having a top end and a lower end;

a top end tip affixed to the top end of the shaft and a lower end tip affixed to the lower end of the shaft;

a primary flywheel located adjacent the top end tip, having a symmetrical shape about the shaft as a central axis, and affixed to the shaft through the central axis;

a handle having a symmetrical shape about the shaft as a central axis and having a widest diameter and a longitudinal length approximately equal and further having an upper end on the handle's central axis nearest the primary flywheel and a lower end opposite thereto and a center in between, and having the widest diameter of the handle located between the upper end and center; the handle is rotatably connected to the shaft through the handle's central axis, adjacent the primary flywheel at the upper end and adjacent to the lower end tip at the lower end of the handle;

the lower end tip and the primary flywheel are located on the rigid shaft to retain the handle in a rotatable position on the shaft;

a tangential point on the handle between the upper and lower ends of the handle and defined by the tangential line of the handle that has as one point the lower end tip;

a symmetrical secondary flywheel smaller than the primary flywheel, through which the shaft penetrates such that the shaft is the central axis about which the secondary flywheel is symmetrical, and located near the lower end of the handle;

a string attached to the shaft;

a hole in the handle through which the string passes.

2. A spinning toy comprised of:

a rigid shaft having a top end and a lower end;

a top end tip affixed to the top end of the shaft and a lower end tip affixed to the lower end of the shaft, each having essentially a conical shape near the end of each tip;

a primary flywheel located adjacent the top end tip, having a symmetrical shape about the shaft as a central axis, and affixed to the shaft through the central axis; and further having a diameter perpendicular to the central axis;

a handle having a symmetrical shape about the shaft as a central axis and having a widest diameter perpendicular to the central axis and a longitudinal length perpendicular to said widest diameter, which lengths are within 20% of each other and the primary flywheel diameter, and further having an upper end on the handle's central axis nearest the primary flywheel and a lower end opposite thereto and a center in between, and having the widest diameter of the handle located between the upper end and center; the handle is rotatably connected to the shaft through the handle's central axis, adjacent to the primary flywheel at the upper end and adjacent to the lower end tip at the lower end of the handle;

the lower end tip and the primary flywheel are located on the rigid shaft to retain the handle in a rotatable position on the shaft;

a tangential point on the handle approximately midway between the upper and lower ends of the handle and defined by the tangential line of the handle that has as one point the lower end tip;

a symmetrical secondary flywheel smaller than the primary flywheel, through which the shaft penetrates such that the shaft is the central axis about which the secondary flywheel is symmetrical, and located adjacent the handle at the lower end of the handle;

a string attached to the shaft;

a hole in the handle located near the middle of the handle, through which the string passes.

3. The invention as in claim 1 having a flattened protruding surface on either side of the handle between the upper and lower end thereof, and further having an angle created by the tangential line and the shaft of at least 15°.

4. The invention as in claim 2 having a flattened protruding surface on either side of the handle between the upper and lower end thereof, and further having an angle created by the tangential line and the shaft of at least 15°.

* * * * *